US011427015B2

(12) United States Patent
Speith et al.

(10) Patent No.: US 11,427,015 B2
(45) Date of Patent: Aug. 30, 2022

(54) PRINTER FOR MARKING STRIPS

(71) Applicant: Weidmüller Interface GmbH & Co. KG, Detmold (DE)

(72) Inventors: Markus Speith, Paderborn (DE); Thomas Köster, Schlangen (DE)

(73) Assignee: Weidmüller Interface GmbH & Co., KG

( * ) Notice: Subject to any disclaimer, the term of this patent is extended or adjusted under 35 U.S.C. 154(b) by 195 days.

(21) Appl. No.: 16/499,590

(22) PCT Filed: Apr. 9, 2018

(86) PCT No.: PCT/EP2018/058958
§ 371 (c)(1),
(2) Date: Sep. 30, 2019

(87) PCT Pub. No.: WO2018/189066
PCT Pub. Date: Oct. 18, 2018

(65) Prior Publication Data

US 2020/0023652 A1 Jan. 23, 2020

(30) Foreign Application Priority Data

Apr. 12, 2017 (DE) ..... 202017102224

(51) Int. Cl.

| | |
|---|---|
| ***B41J 3/407*** | (2006.01) |
| ***B41J 2/325*** | (2006.01) |
| ***B41J 11/057*** | (2006.01) |
| ***B41J 13/10*** | (2006.01) |

(52) U.S. Cl.
CPC ..... *B41J 3/4075* (2013.01); *B41J 2/325* (2013.01); *B41J 11/057* (2013.01); *B41J 13/10* (2013.01)

(58) Field of Classification Search
None
See application file for complete search history.

(56) References Cited

U.S. PATENT DOCUMENTS

| | | | |
|---|---|---|---|
| 5,772,203 A | 6/1998 | Masek et al. | |
| 10,369,735 B2 | 8/2019 | Speith et al. | |
| 2003/0197776 A1* | 10/2003 | Ito | B41J 11/057 347/213 |

(Continued)

FOREIGN PATENT DOCUMENTS

| | | |
|---|---|---|
| DE | 3504634 A1 | 8/1985 |
| DE | 102007011179 A1 | 9/2008 |

(Continued)

*Primary Examiner* — Jill E Culler
(74) *Attorney, Agent, or Firm* — Laubscher & Laubscher, P.C.

(57) ABSTRACT

A printer is provided for printing marking strips having a plurality of marking elements for marking electric devices which can be arranged next to one another. Each of the marking elements has a marking plate with at least one writing field which can be printed with information such as writing. The printer has a rotatably mounted feed shaft which can be driven by a motor and a printing head. The rotatably mounted feed shaft has at least one section which is provided with protrusions and which rests directly against the marking strip while the feed shaft is rotated such that the advancing speed of the marking strip is synchronized with the circumferential speed of the feed shaft.

11 Claims, 7 Drawing Sheets

(56) References Cited

U.S. PATENT DOCUMENTS

| | | | |
|---|---|---|---|
| 2008/0089732 | A1 | 4/2008 | Szoke |
| 2010/0011979 | A1 | 1/2010 | Bier et al. |

FOREIGN PATENT DOCUMENTS

| | | | |
|---|---|---|---|
| DE | 102015109020 | A1 | 3/2016 |
| EP | 1356947 | A1 | 10/2003 |
| WO | 2015151042 | A2 | 10/2015 |

* cited by examiner

PRINTER FOR MARKING STRIPS

This application is a § 371 National Stage Entry of International Patent Application No. PCT/EP2018/058958 filed Apr. 9, 2018. Application No. PCT/EP2018/058958 claims priority of DE 202017102224.2 filed Apr. 12, 2017. The entire content of these applications are incorporated herein by reference.

BACKGROUND OF THE INVENTION

The invention relates to a printer for printing marking strips having a plurality of marking elements for marking electric devices, in particular electric devices which can be arranged next to one another. Each of the marking elements has a marking plate with at least one writing field which can be printed with information such as writing. The printer has a rotatably mounted feed shaft, which can be driven by a motor, and a printing head.

If a plurality of electric devices, such as terminal blocks, are arranged next to one another on a submount, each having a latch contour such as a latch recess, the marking process is simplified by employing marking elements which are connected to one another in a strip-shaped pattern as opposed to a plurality of completely discrete marking elements. For example, for marking a terminal block assembly on a mounting rail, it is only necessary to place the marking strip above the area of the latch contours of the terminal blocks which are arranged next to one another and then to press on the individual marking elements from above such that secure latching of the marking elements to the terminal blocks is accomplished.

As an example, in order to manufacture such marking strips, injection molding methods are used in which strips of a defined length of, for example, eight marking elements are constructed, which are then joined to equip a reel with a long marking strip off of which marking strips with a desired amount of marking elements can then be cut.

From DE 10 2015 109 020 A1 it is known to produce a marking strip from at least two different plastic materials of different hardness, the latching contour of each marking element consisting of the harder material and the marking plate consisting of the softer plastic material at least in the area of the writing field. Preferably, the marking strip is initially manufactured in an extrusion process and then processed further. Extrusion allows simple production of a continuous strip for winding it, e.g., onto a reel. By using extrusion such as co-extrusion, the marking strips or their marking elements can then be used for printing by thermal transfer technology. If the latch contour of each marking element is made of a harder plastic material, it can be readily and securely latched onto the given electric device. Furthermore, it is advantageous for the marking plate to consist of the softer plastic material at least in the area of the writing field. As such it can be printed on more precisely. The softer material facilitates automatic adjustment to the printing head and is also gentler on the printing head than a harder material.

Further, it is advantageous if each connecting area between the marking elements includes at least one or more connecting web(s) and if at least one hole, in particular an elongated hole, is formed in the connecting area between adjacent marking elements. The hole penetrates the marking elements in a latching direction perpendicular to the arrangement direction. The hole allows the resilience of the connecting area to be selectively increased or adjusted. In addition, the hole is readily usable as a sensing device for a sensor of a printer to trigger or stop printing. However, it is also contemplated that the marking plate of the marking strip does not contain any holes and/or edge recesses. This makes it easy to write across devices. The marking strip is also provided with markings in the form of printings at the bottom, for example, with markings applied in a grid and having different colors compared to the material of the marking strip, which are easy to sense and are usable as a reference for the printing process. These different types of marking strips and sensing and printing methods are usable with the printer according to the invention.

Irrespective of the type of manufacture and nature of the marking strip used, it is desirable to print the marking strip in a dedicated printer in its main direction of extension as precisely as possible such that the desired print image is printed exactly within the area of the intended marking plate.

SUMMARY OF THE INVENTION

According to the invention, a printer is provided with a rotatably mounted feed shaft which has at least one protrusion section which is provided with protrusions and which rests directly against the marking strip while the feed shaft is rotated, such that the advancing speed of the marking strip is synchronized with the circumferential speed of the feed shaft.

In this manner, a defined, tolerance-free feed of the marking strip is provided resulting in a clean print image without any offset, particularly in its main direction of extension.

Further, the protrusion section rests directly against the marking strip while the feed shaft is rotated such that the protrusions of the protrusion section each introduce a deformation into the marking strip, creating a positive fit between the feed shaft and the marking strip such that the advancing speed of the marking strip is synchronized with the circumferential speed of the feed shaft.

According to one embodiment which results in a very smooth feed motion of the marking strip, the protrusion section is formed as an interlocking section. Preferably, the interlocking section creates a positive fit and also a frictional connection, thus ensuring smooth further transport of the marking strip at all times. It does not have to create any deformation during feeding of the marking strip.

Preferably, the protrusion section is formed as an axial section of the feed shaft, preferably enclosing the shaft completely or almost completely and having a surface roughness which is configured such that, when transporting a marking strip made of at least one plastic material through one or more radially extending protrusions, a positive fit is created between the section having the surface roughness and the marking strip while transporting the marking strip. A sufficiently high surface roughness may be created in several ways. For example, a section of the shaft may be provided with small, radially extending protrusions, in particular tips, all around, which penetrate the plastic material from which the marking strip is made. It may also be coated with a band of sufficiently high or increased surface roughness all around an axial section.

As such, the defined and—from a practical view—zero-tolerance feed of the marking strip may be ensured in a simple and cost-effective manner, resulting in a clean print image without offset in its main direction of extension.

According to another embodiment, the at least one interlocking section is a first interlocking section having a first diameter and a first interlock, in particular a saw-toothed interlock. The tooth shape of the interlock is preferably pointed to produce a precise feed when printing the marking strip.

According to a further embodiment, the feed shaft has one or more additional interlocking protrusion sections, which are axially offset from the first protrusion section or which each rest directly against the marking strip in at least one additional area with a defined pressure force while the feed shaft is rotated such that the advancing speed of the marking strip is synchronized with the circumferential speed of the feed shaft also in these areas.

This allows an even more precise motion of the marking strip during printing. In addition, sensing of markings such as holes or stripes or the like may be accomplished for referencing during printing.

In a further embodiment of the invention, the pressure force applied onto the marking strip by the printing head is effective to press the protrusions formed by the interlock, into the marking strip. Each tooth of the interlock creates a permanent indentation in the marking strip. This creates a positive fit between the interlock and the marking strip, enabling precise feed.

In a further embodiment of the invention, each of the additional interlocking sections also has a saw-toothed interlock on its periphery. In turn, the pointed tooth shape of this interlock creates a precise feed when printing the marking strip.

BRIEF DESCRIPTION OF THE FIGURES

Other objects and advantages of the invention will be described in greater detail with reference to the accompanying drawings in which.

DETAILED DESCRIPTION

Figure 1:
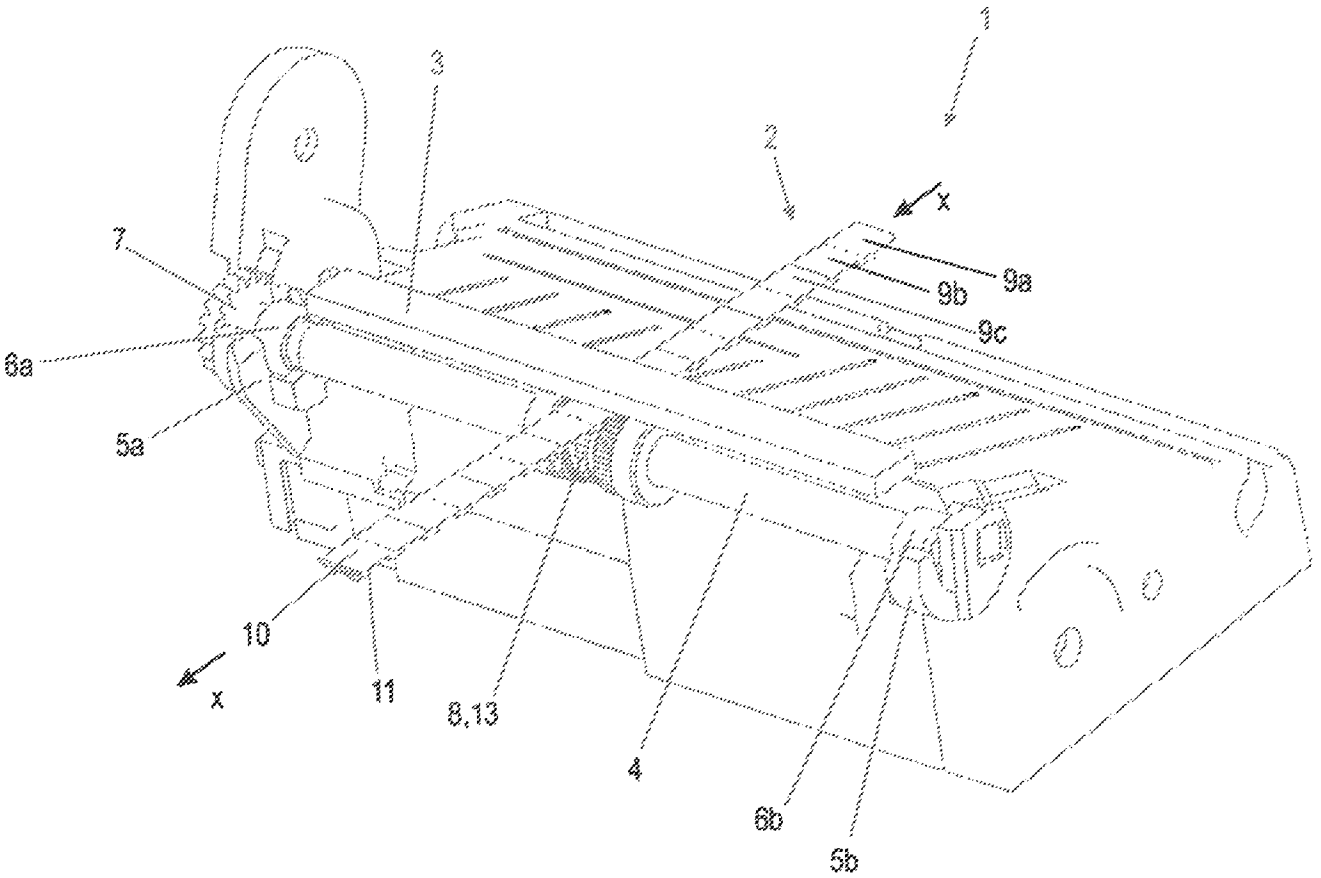
FIG. 1 is a perspective view of a printer for printing multiple marking strips.
Figure 3B:
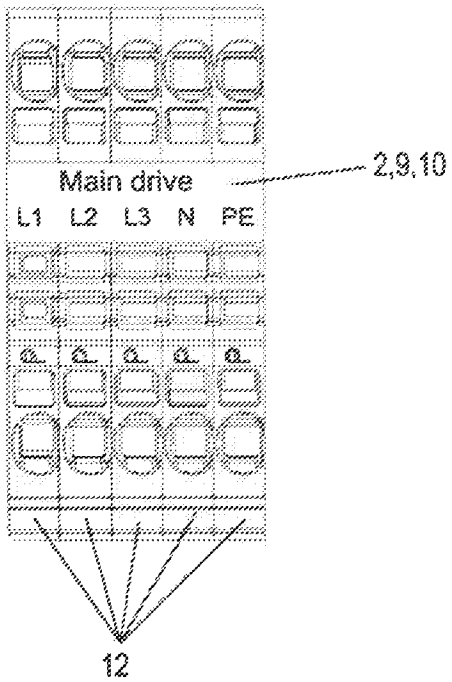
FIGS. 3*a* and 3*b* are sectional and front views, respectively of terminal blocks arranged next to one another with an inserted marking strip.
Figure 3A:
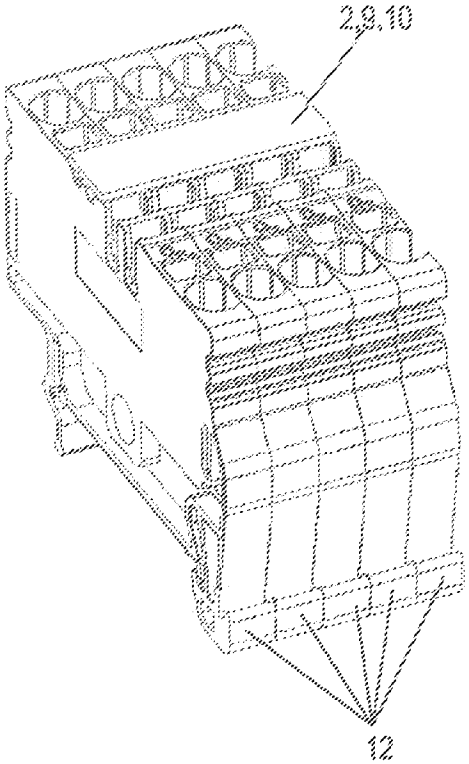

FIG. 1 is a simplified illustration of a printer 1 for printing continuous marking strips 2. Marking strips 2 are used for marking electric devices which can be arranged next to one another, such as terminal blocks as shown in FIG. 3*a* and FIG. 3*b*. The printer may have further components, such as a cover or the like, which are not shown.

Printer 1 is preferably designed as a direct thermal printer or a thermal transfer printer. Alternatively, printer 1 may also be intended for other printing methods, such as ink jet or laser printing.

Printer 1 has a printing head 3 preferably arranged above a feed shaft 4. Marking strip 2 is advanced between these two elements. Printing head 3 is preferably spring-loaded—in FIG. 1 from top to bottom—and presses marking strip 2 onto feed shaft 4. As such, feed shaft 4 also rests against marking strip 2 with a predetermined or defined force.

Feed shaft 4 may be inserted into two bearing seats 5*a*, 5*b*. Feed shaft 4 may further have respective bearings 6*a*, 6*b*—preferably one at each of its ends. With these bearings 6*a*, 6*b*, feed shaft 4 is rotatably mounted on printer 1. Further, feed shaft 4 has a gear 7, at least at one of its free ends, which can mesh with a corresponding mating gear (not shown). The mating gear is driven by a motor (also not shown) located within printer 1.

Thanks to this drive, feed shaft 4 can be rotated. The rotating motion of feed shaft 4 is suitably controlled by a printer controller (not shown).

The rotatably mounted feed shaft 4 has at least one interlocking section 8 which is shown by way of example only as being arranged in the middle between bearings 6*a*, 6*b* and which rests directly against marking strip 2 by a defined pressure force produced by printing head 3 when feed shaft 4 is rotated such that the advancing speed of marking strip 2 is synchronized with the circumferential speed of feed shaft 4. An advancing motion is produced in direction X corresponding to the main direction of extension X of marking strip 2. Instead of an interlocking section, another protrusion section may also be provided (not shown). As an example, instead of the interlock with teeth, the protrusion section may have differently shaped protrusions which may engage the material of the marking strip in a somewhat positive fit to advance it.

This allows a precisely defined advancing movement of the marking strip during printing in this direction to be provided easily and cost-effectively. The print image is easily applied in the dedicated areas in the main direction of extension which is the same as the advancing direction.

The interlocking section 8 will be described in greater detail further below.

Figure 2A:
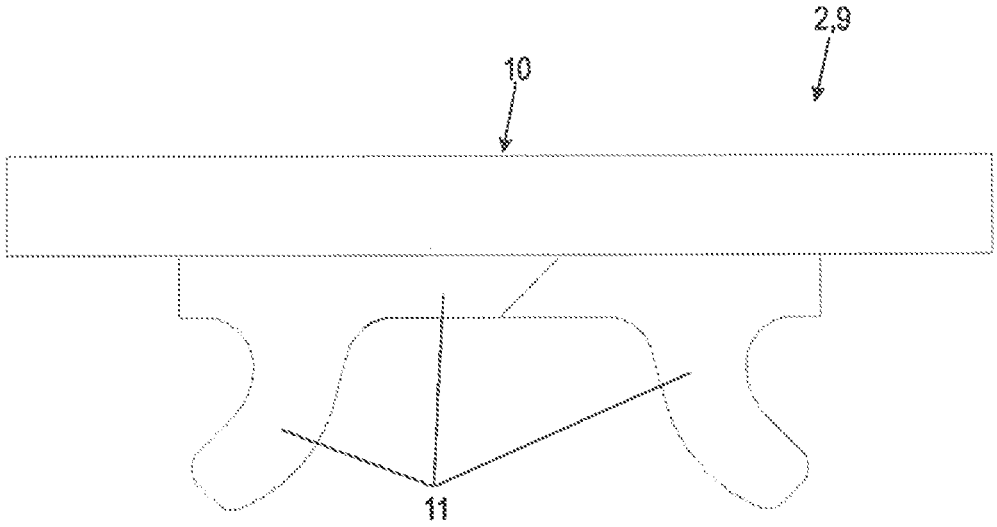
FIG. 2*a* is a sectional view of a first embodiment of a marking strip and FIG. 2*b* is a sectional view of a further embodiment of a continuous marking strip.
Figure 2B:
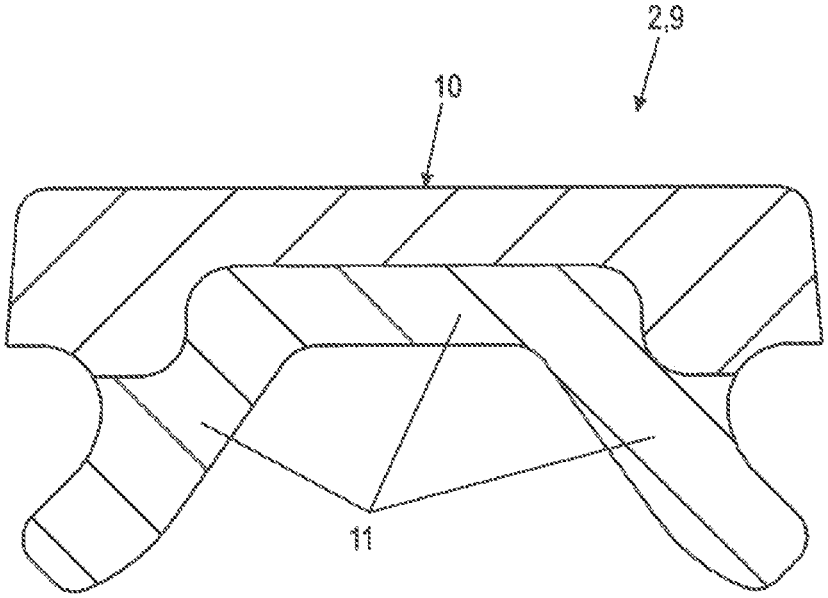
Figure 6:
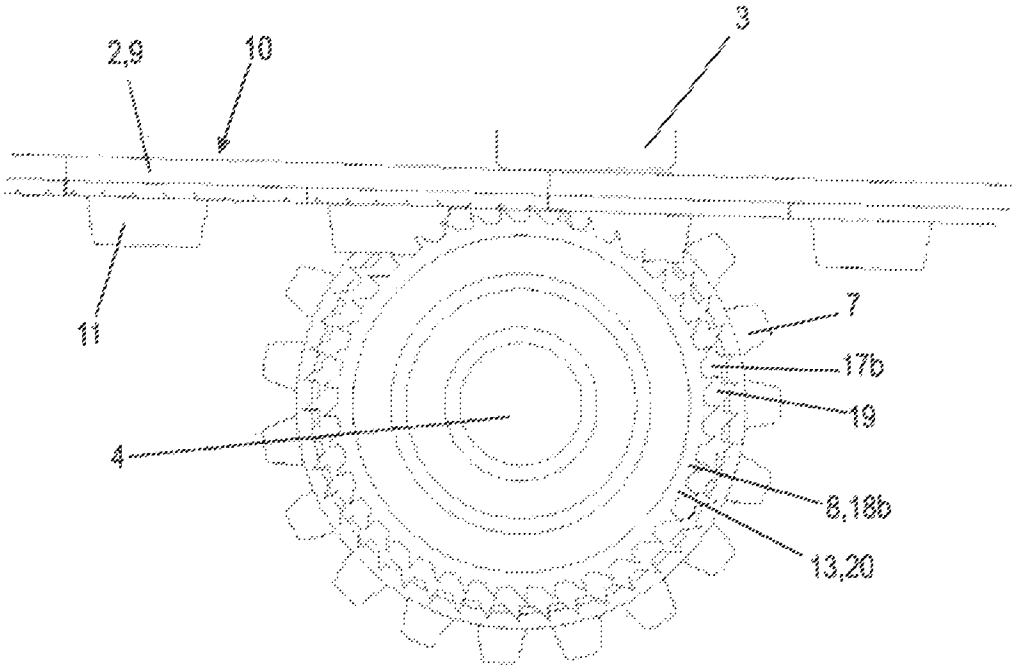
FIG. 6 is a sectional side view of the roller and the printing head with the continuous marking strip of FIG. 5.

FIG. 2*a* and FIG. 2*b* show two exemplary embodiments of the continuous marking strip. Marking strip 2 has multiple marking elements 9 which are shown in FIG. 6. Each marking element 9 has a marking surface 10 with at least one writing field which can be provided with information such as writing. Preferably, the writing field is configured to be printed with printer 1.

On the side facing away from the writing field, each marking element 9 may further have a latch contour 11 integrally formed with the respective marking plate 10 for latching attachment of a corresponding latch contour (not shown) of a corresponding electrical device. For this purpose, latch contour 11 has latch lugs. While this is advantageous, the invention is also suitable for marking strips without latch contours.

Marking strip 2 is made of plastic and produced by an extrusion process, preferably a co-extrusion process, wherein preferred cross-sections can be derived as shown in FIG. 2*a* and FIG. 2*b*. Preferably, this extrusion process results in areas forming marking plate 10 with the writing surface upon completion being made of a first material that is softer than that of latch contour 11 which is made of a harder second material.

For marking an assembly of terminal blocks 12 on a mounting rail, it is then only necessary to place marking strip 2 above the area of the latch contours of the terminal blocks which are arranged next to one another as shown in FIGS. 3*a* and 3*b* and then to press on the individual marking elements 9 from above such that secure latching of marking elements 9 to the terminal blocks is accomplished. The marking strip is cut from a continuous strip, such as on a reel, such that the number of marking elements 9*a, b, c*, . .

. corresponds to the number of devices arranged next to one another which are to be marked. Thus, marking strip 2 of FIG. 2*a* or FIG. 2*b* is suitable for marking three devices arranged next to one another. However, many more devices arranged next to one another can be marked within a single operation.

A detailed design of continuous marking strip 2 is described in DE 10 2015 109 020 A1. It should be noted that the marking strips could also be different in design.

In FIG. 3*a* or FIG. 3*b*, the word "MAIN DRIVE" printed across devices as an example. Thus, the wording "MAIN DRIVE", such as a drive motor powered with 3-phase alternating voltage L1 to L3 and having a neutral connection N and a protective ground terminal PE spans five devices, i.e. terminal blocks 12.

Figure 4:
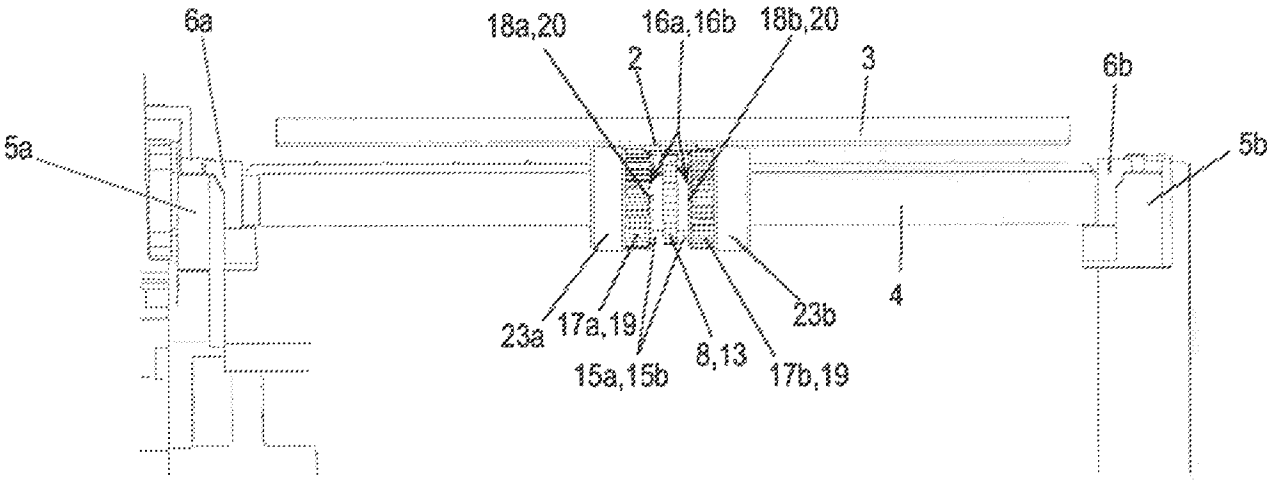
FIG. 4 is a partial front view of a roller and a printing head with a continuous marking strip of the printer of FIG. 1.

In FIG. 4, feed shaft 4 is shown with interlocking section 8 and printing head 3 of printer 1. Between feed shaft 4 and printing head 3, a marking strip 2 to be printed is inserted in the area of interlocking section 8.

Here, as an example, interlocking section 8 is positioned approximately or precisely centered on feed shaft 4 with respect to the longitudinal extension thereof. Interlocking section 8 has interlock 13 around its entire periphery. It may be designed as a saw-toothed interlock. Further, interlocking section 8 engages with a gap between the latch lugs of latch contour 1*i* formed by marking strip 2. In this area, a precise feed is advantageous.

Figure 7:
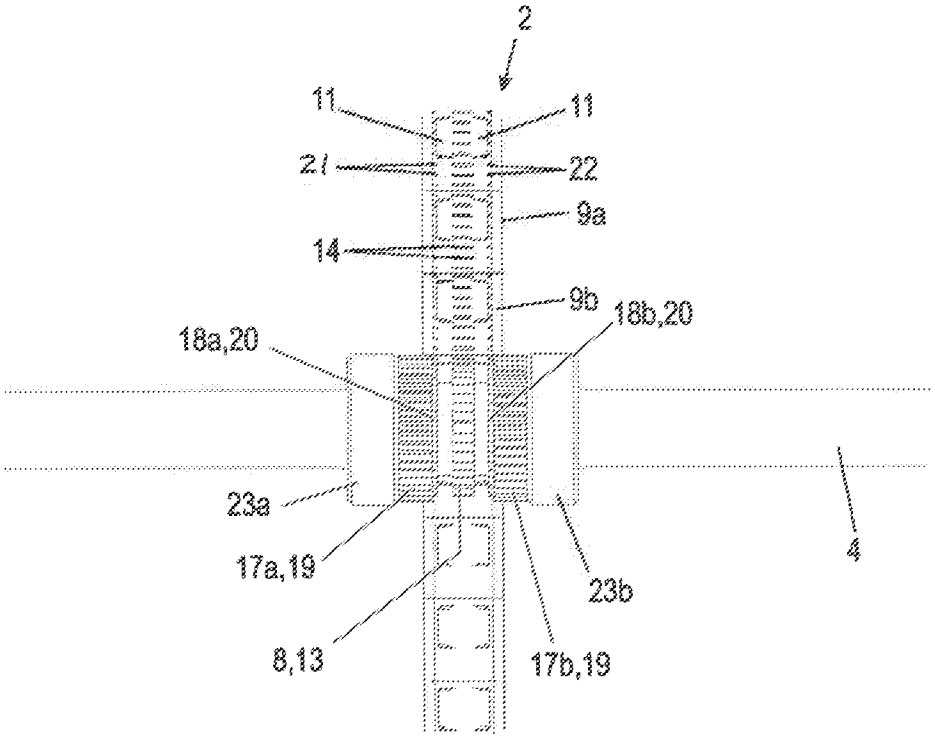
FIG. 7 is a bottom view of the roller and the printing head with the continuous marking strip of FIG. 4.

During rotating motion of feed shaft 4, at least one interlock 13 produces indentations in at least one area due to the pressure force preferably but not necessarily applied by printing head 3 to marking strip 2. The respective indentation 14 may be a permanent indentation 14 as shown in FIG. 7.

Each tooth of interlock 13 creates these indentations during the rotating motion of feed shaft 4 in a base of latch contour 11.

Preferably, this allows a positive fit to be easily created between marking strip 2 and interlock 13 or interlocking section 8, resulting in a precise feed.

Next to interlocking section 8, feed shaft 4 has two respective tooth-less sections 15*a*, 15*b* of a small diameter arranged symmetrically with respect to the interlocking section.

Small-diameter toothless sections 15*a*, 15*b* are designed such that the latch lugs of latch contour 11 may freely move therein without contact with respect to a radial direction and may be guided on both sides of a shoulder 16*a*, 16*b* of a respective additional interlocking section 17*a*, 17*b* with respect to an axial direction.

The additional interlocking sections 17*a*, 17*b* also rest directly against marking strip 2 due to the pressure force created by printing head 3 while feed shaft 4 is rotated such that the advancing speed of marking strip 2 is synchronized with the circumferential speed of feed shaft 4 in additional areas of marking strip 2. Here, the interlocking sections rest against marking plates 10 from beneath and provide for precise feed of these elements directly in the proximity of the actual areas to be printed.

For this purpose, the respective interlocking sections 17*a*, 17*b* preferably have an interlock 19 extending across its periphery. The latter may have a saw-toothed design.

The interlocking sections 17*a*, 17*b* axially offset from the first interlocking section may each have a step 18*a*, 18*b* with another radius, such as a smaller radius, than that of interlocking sections 17*a*, 17*b*. On its periphery, each respective step 18*a*, 18*b* preferably has an interlock 20. The respective step 18*a*, 18*b* also rests directly against marking strip 2 in an area under the defined pressure force created by printing head 3 while feed shaft 4 is rotated such that the advancing speed of marking strip 2 is synchronized with the circumferential speed of feed shaft 4 in still another area such as at a part of the latch contour. What is essential is that one or more interlocks on different diameters may be used to perform an adjustment to the respective marking geometry to implement a feed motion of the marking strip as precisely as possible.

While feed shaft 4 is rotated, each tooth of interlocks 19, 20 also creates a respective resilient or plastic deformation or indentation 21, 22 as shown in FIG. 7 in a lug of latch contour 11 or on the side of marking plate 10 facing away from the printable side of marking plate 10 due to the pressure force applied by printing head to mark strip, with which the respective interlock 19 or 20 engages such that a positive fit is created between marking strip 2 and the respective interlock 19, 20 or the respective interlocking section 17*a*, 17*b*, to insure a tolerance-free feed of marking strip 2 during printing.

Not all of the protrusions or interlocks have to leave a permanent indentation. For instance, it may not be desirable to create permanent indentations which might affect the visual appearance in places such as at the sides of the marking strip which will be visible after attaching the marking strip to a device.

At the axial external surfaces of each of the further axial interlocking sections 17*a*, 17*b*, feed shaft 4 may have a respective section 23*a*, 23*b* having a larger outer diameter than the interlocking sections with respect to interlocking sections 8, 17*a*, 17*b*. Thus, printing head 3 of printer 1 may be protected while no marking strip 2 is being printed.

Figure 5:
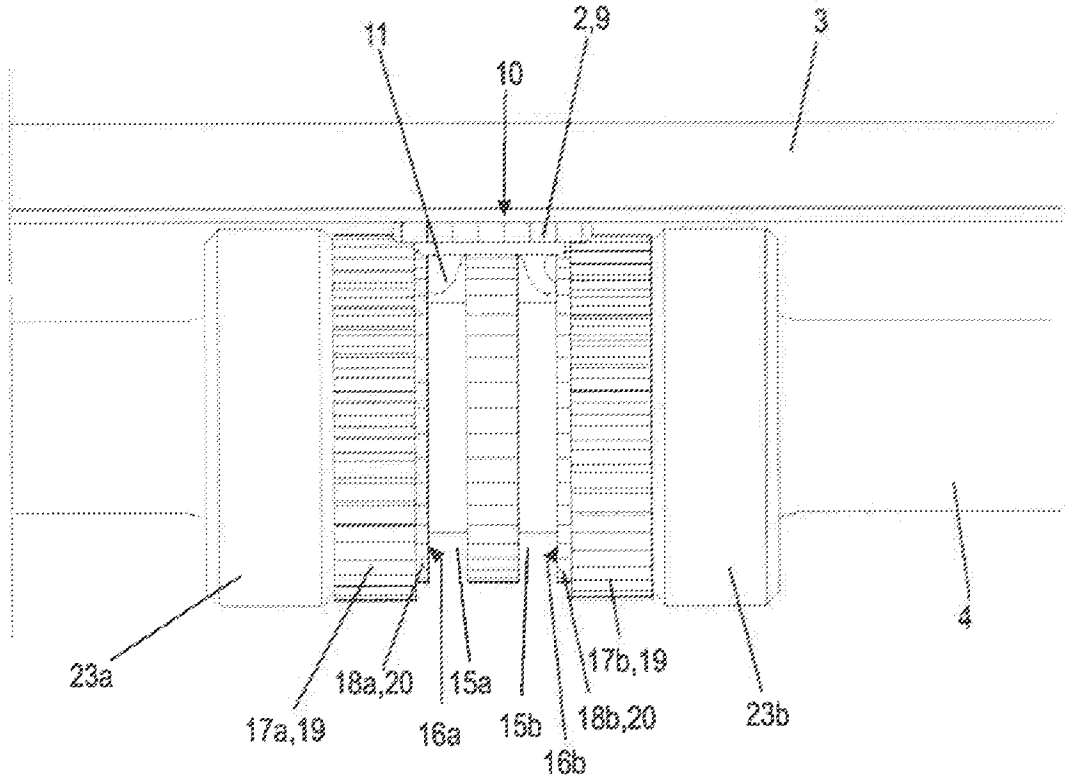
FIG. 5 is an enlarged detail view of the roller and the printing head with the continuous marking strip of FIG. 4.

In FIG. 5, printing head 3 and feed shaft 4 are shown with the respective interlocking sections 8, 17*a*, 17*b*, shoulders 16*a*, 16*b* and steps 18*a*, 18*b* and interlocks 13, 19, 20.

In FIG. 6, interlocks 13, 19, 20 and indentations in marking strip 2 which are formed by interlock 13 are shown.

In FIG. 7, indentations 14, 22 formed by interlocks 13, 20 in marking strip 2 are shown. Marking elements 9 of marking strip 2 are also shown.

While the preferred forms and embodiments of the invention have been illustrated and described, it will be apparent to those of ordinary skill in the art that various changes and modifications may be made without deviating from the inventive concepts set forth above.

The invention claimed is:

1. A printer for printing synthetic plastic marking strips formed of a first material and a second material which is harder than said first material, comprising (a) a rotatably mounted feed shaft which is driven by a motor; and, said feed shaft including at least one protrusion section formed as a saw-toothed interlock having a first diameter, said feed shaft protrusion section engaging and interlocking with the marking strip second material while said feed shaft is rotated to create a plurality of permanent indentations in the marking strip second material and to advance the marking strip in a linear direction at an advancing speed which is synchronized with a circumferential speed of said feed shaft; and (b) a printing head arranged adjacent to said feed shaft for printing on said marking strip first material.

2. The printer according to claim 1, wherein said protrusion section rests directly against said marking strip while said feed shaft is rotated, said permanent indentations creating a positive engagement between said feed shaft and the marking strip to synchronize the advancing speed of the marking strip with the circumferential speed of said feed shaft.

3. The printer according to claim 1, wherein said feed shaft includes at least two protrusion sections formed saw-toothed interlocks, respectively, which are axially offset and engage and interlock with the marking strip in different areas with a defined pressure while said feed shaft is rotated.

4. The printer according to claim 3, wherein said saw-toothed interlocks of said protrusion sections have a different diameter, respectively.

5. The printer according to claim 4, wherein said saw-toothed interlocks are arranged at a periphery of each section.

6. The printer according to claim 5, wherein said feed shaft has circumferential tooth-less sections.

7. The printer according to claim 3, wherein the pressure applied by said feed shaft to the marking strip is controlled to insure that said saw-toothed interlocks each press into the marking strip second material while the marking strip is advanced.

8. A printer for printing marking strips, comprising (a) a rotatably mounted feed shaft which is driven by a motor, said feed shaft including at least one protrusion section formed as a saw-toothed interlock having a first diameter, said feed shaft protrusion section engaging and interlocking with the marking strip while said feed shaft is rotated to create a plurality of permanent indentations in the marking strip and to advance the marking strip in a linear direction at an advancing speed which is synchronized with a circumferential speed of said feed shaft wherein said feed shaft has circumferential tooth-less sections which accommodate latch lugs of a latch contour of the marking strip without contact while the marking strip is advanced (b) a printing head arranged adjacent to said feed shaft.

9. The printer according to claim 8, wherein the marking strip is formed of at least one plastic material.

10. The printer according to claim 8, wherein said interlocking sections include a shoulder which guides the latch lugs of the marking strip.

11. A printer assembly, comprising (a) a printing head;

(b) a synthetic plastic marking strip to be printed by said printing head, said marking strips including a first portion formed of a first material which receives printed indicia from said printing head and a second portion formed of a second material which is harder than said first material for subsequent attachment to an item to marked; and (c) a rotatably mounted feed shaft which is driven by a motor, said feed shaft including at least one protrusion section formed as a saw-toothed interlock having a first diameter, said feed shaft protrusion section engaging and interlocking with the marking strip second material while said feed shaft is rotated to create a plurality of permanent indentations in the marking strip second material and to advance the marking strip in a linear direction at an advancing speed which is synchronized with a circumferential speed of said feed shaft.

* * * * *